US008732899B2

(12) United States Patent
Park et al.

(10) Patent No.: US 8,732,899 B2
(45) Date of Patent: May 27, 2014

(54) VACUUM CLEANER

(75) Inventors: Sang-Jun Park, Changwon-si (KR); Young-Min Hyun, Changwon-si (KR); Hyuk-Joo Kwon, Changwon-si (KR); Hyo-Churl Shin, Changwon-si (KR); Hae-Seock Yang, Changwon-si (KR); Jin-Wook Seo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 224 days.

(21) Appl. No.: 13/147,936

(22) PCT Filed: Feb. 12, 2009

(86) PCT No.: PCT/KR2009/000688

§ 371 (c)(1),
(2), (4) Date: Aug. 4, 2011

(87) PCT Pub. No.: WO2010/093073

PCT Pub. Date: Aug. 19, 2010

(65) Prior Publication Data

US 2011/0289725 A1 Dec. 1, 2011

(51) Int. Cl.
*A47L 5/34* (2006.01)

(52) U.S. Cl.
USPC ..... 15/339; 15/354

(58) Field of Classification Search
USPC ..... 15/354, 339, 358, 332, 333
See application file for complete search history.

(56) References Cited

U.S. PATENT DOCUMENTS

| | | | | |
|---|---|---|---|---|
| 4,614,003 | A * | 9/1986 | Martin | 15/339 |
| 4,955,103 | A | 9/1990 | Scott et al. | |
| 7,913,353 | B2 * | 3/2011 | Park et al. | 15/358 |
| 8,214,966 | B2 * | 7/2012 | Steffen et al. | 15/339 |
| 2008/0289141 | A1 * | 11/2008 | Oh et al. | 15/354 |

FOREIGN PATENT DOCUMENTS

| | | |
|---|---|---|
| JP | 2006-346279 | 12/2006 |
| KR | 10-2007-059223 | 6/2007 |
| KR | 10-2008-009455 | 1/2008 |

OTHER PUBLICATIONS

International Search Report issued in PCT Application No. PCT/KR2009/000688 dated Nov. 11, 2009.

* cited by examiner

*Primary Examiner* — Dung Van Nguyen
(74) *Attorney, Agent, or Firm* — Ked & Associates, LLP

(57) ABSTRACT

The embodiments disclose a vacuum cleaner. The vacuum cleaner includes a suction nozzle capable to adjusting the height with regard to the bottom surface.

18 Claims, 12 Drawing Sheets

VACUUM CLEANER

FIELD OF THE INVENTION

The present invention relates a vacuum cleaner.

DESCRIPTION OF THE RELATED ART

Typically, a vacuum cleaner is an apparatus for separating dust after inhaling air containing dust by using a suction force generated by a suction motor included in a main body.

The vacuum cleaner may be divided into a canister type vacuum cleaner in which a suction nozzle is separately provided from the main body and is connected to a connection unit, and an upright type vacuum cleaner in which the suction nozzle is rotatably connected to the main body.

Meanwhile, the upright-type vacuum cleaner includes a cleaner body having a suction motor generating a suction force, a suction nozzle rotatably connected to the lower side of the cleaner body to inhale the dust on a surface to be cleaned, and a dust separating unit mounted in the cleaner body.

An agitator is provided in the suction nozzle, which is easy to clean a bottom surface, in particular, the bottom surface such as a carpet to be cleaned.

The effect of the vacuum cleaner having the configuration described above may be briefly explained. That is, when power is applied to the cleaner body and the suction motor is driven, a suction force from the suction motor is generated. In addition, the user grasps the handle provided in the cleaner body and performs the cleaning while moving the suction nozzle back and forth. Then, the air containing dust on the bottom surface is absorbed through the suction nozzle.

In addition, the air containing dust is introduced into the dust separation unit after passing the cleaner body. The air and dust are separated in the dust separation unit and the separated dust is saved in the dust separation unit. On the other hand, the dust and separated air are discharged outside the cleaner body after passing the cleaner body.

At this time, when cleaning the bottom surface such as a carpet, if wool of the carpet is higher, the agitator is not rotated due to the higher wool of the carpet. Therefore, there is need to adjust the height of the suction nozzle with regard to the bottom surface, depending on the wool height of the carpet.

SUMMARY

An object of the embodiment of the present invention is to propose a vacuum cleaner in which the height of the suction nozzle for the bottom surface may be adjusted.

Another object of the embodiment of the present invention is to propose a vacuum cleaner in which the user may easily confirm the current height of the suction nozzle.

According to one aspect of the embodiment of the present invention, the vacuum cleaner includes a suction nozzle disposed with a suction inlet, a cleaner body communicated with the suction inlet of the suction nozzle, a manipulation portion provided to the suction nozzle, a height adjustment unit to adjust the height of the suction nozzle for a bottom surface, a transmission unit to transmit an operating force of the manipulation portion to the height adjustment unit, and a display portion operated by the transmission unit to display the current height of the suction nozzle.

According to another aspect of the embodiment of the present invention, it is characterized that the vacuum cleaner includes a cleaner body, a suction nozzle communicated with the cleaner body and capable of adjustment of the height for the bottom surface, a display portion to display the current height of the suction nozzle, and a display portion supporter supporting the display portion, wherein the display portion is rotated during the process of the height adjustment and the plurality of display units to display the height of the suction nozzle is disposed on the upper surface of the display portion According to the embodiment of the present invention, the height of the suction nozzle may be controlled, thereby facilitating the movement of the suction nozzle, while making the agitator to rotate smoothly, regardless of a state of a surface to be cleaned.

In addition, the display portion to display the current position of the suction nozzle is horizontally rotated, and the display window is formed in the upper body, such that the display portion may be visible to the naked eye easily.

In addition, the display portion is moved by the transmission unit to transmit an operating force of the manipulation portion to the height adjustment unit, such that and an extra manipulation portion or a driving motor and the like to make the display portion tick are unnecessary.

DETAILED DESCRIPTION OF THE EMBODIMENTS

Hereinafter, an embodiment of the present invention will be concretely described with reference to drawings.

Figure 1:
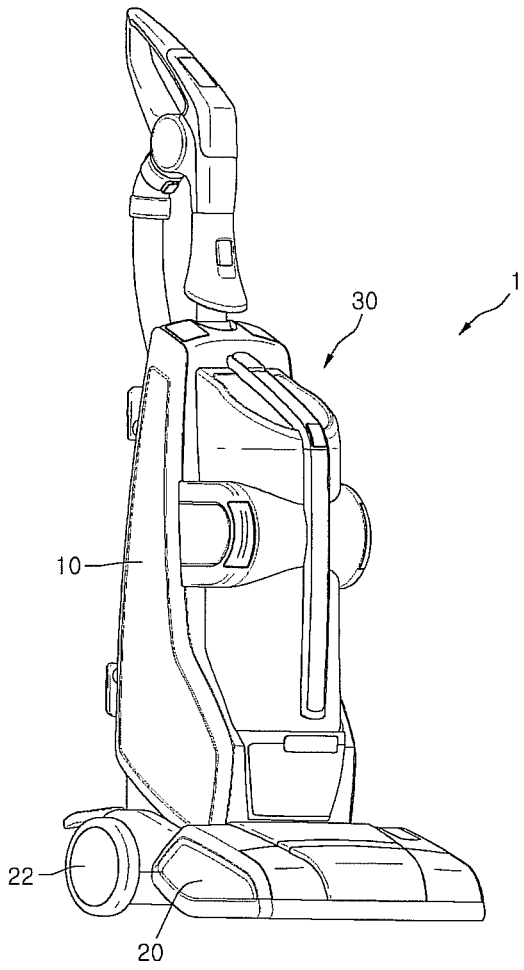
FIG. 1 is a perspective view of a vacuum cleaner according to an embodiment of the present invention.
Figure 2:
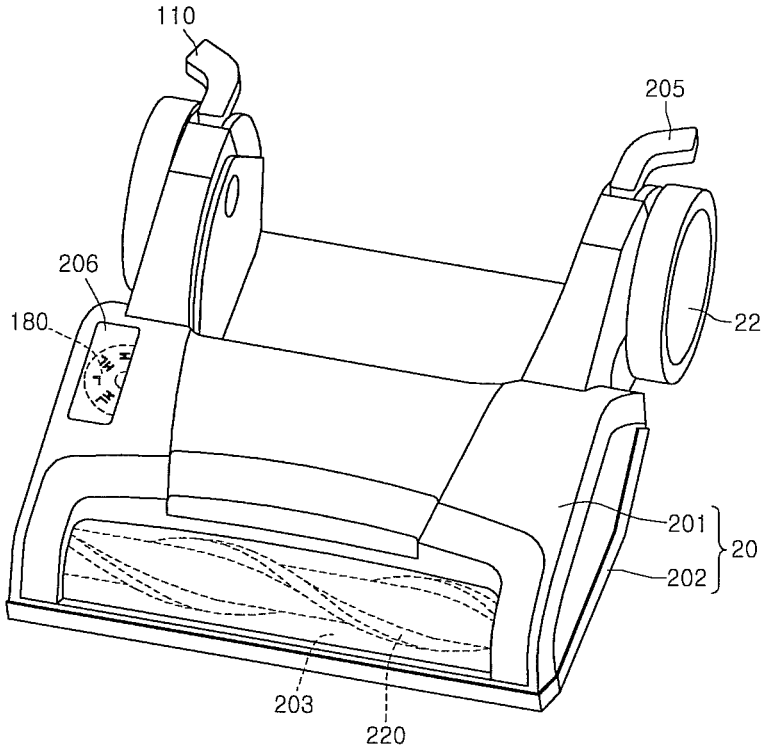
FIG. 2 is a perspective view of a suction nozzle according to the embodiment of the present invention.

FIG. 1 is a perspective view of a vacuum cleaner according to the embodiment of the present invention, and FIG. 2 is a perspective view of a suction nozzle according to the embodiment of the present invention.

Referring to FIGS. 1 and 2, according to the embodiment of the present invention, the vacuum cleaner 1 includes a cleaner body 10 provided with a suction motor (not shown) to generate a suction force, a suction nozzle 20 rotatably connected to the lower side of the cleaner body 10, a dust separating device 30 separately mounted into the cleaner body 10 to separate the dust included in the air.

In detail, a plurality of wheels 22 is included in the suction nozzle 20 to facilitate the movement of the suction nozzle 20. In addition, a lever 205 by which the cleaner body 10 is rotated about the suction nozzle 20 and the manipulation portion 110 which controls the height of the suction nozzle 20 are provided in the real of the suction nozzle 20. For example, the user may control the manipulation portion 110 by using his foot.

In the embodiment of the present invention, the height of the suction nozzle 20 means the bottom height of the suction nozzle 20 from the bottom surface.

The suction nozzle 20 is connected to the upper body 201 and the lower side of the upper body 201, includes the lower body 202 provided with a suction inlet.

The upper body 201 is provided with a display window 206 to facilitate the confirmation of the display portion 180 to display the height of the suction nozzle 20. The display window 206 may be formed of a transparent material as an example.

Therefore, the user may confirm the height of the suction nozzle 20 through the display portion 180 during the cleaning process.

Hereinafter, a height adjustment device which controls the height of the suction nozzle 20 will be described.

Figure 3:
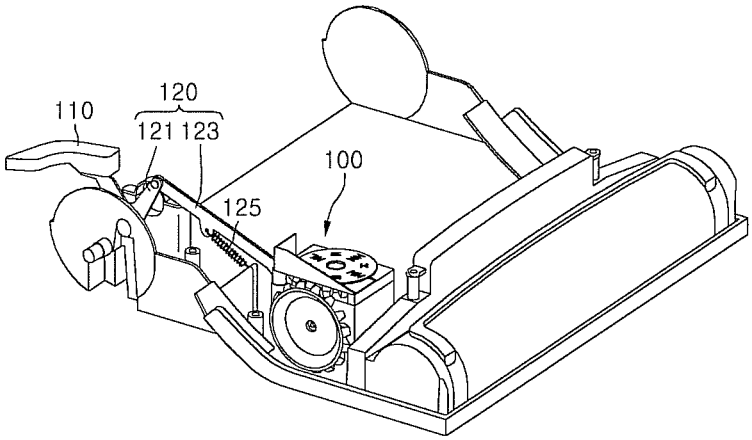
FIG. 3 is a perspective view showing the inner configuration of a suction nozzle according to the embodiment of the present invention
Figure 4:
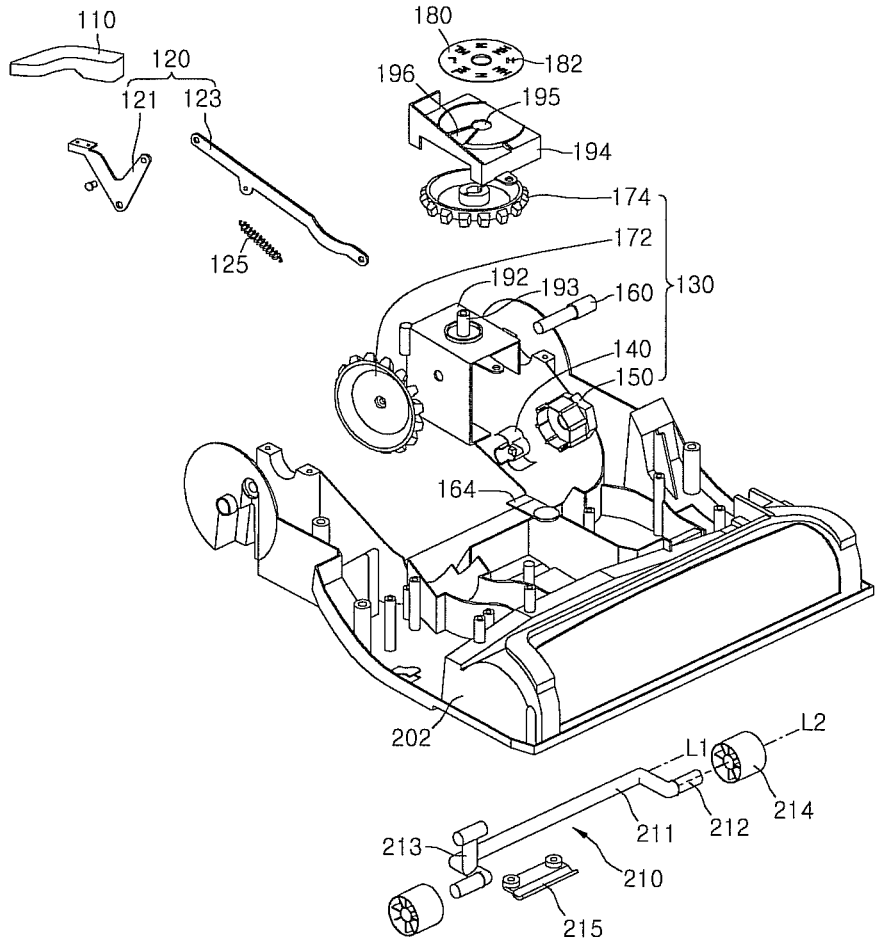
FIG. 4 is a partially exploded perspective view of a suction nozzle according to the embodiment of the present invention.
Figure 5:
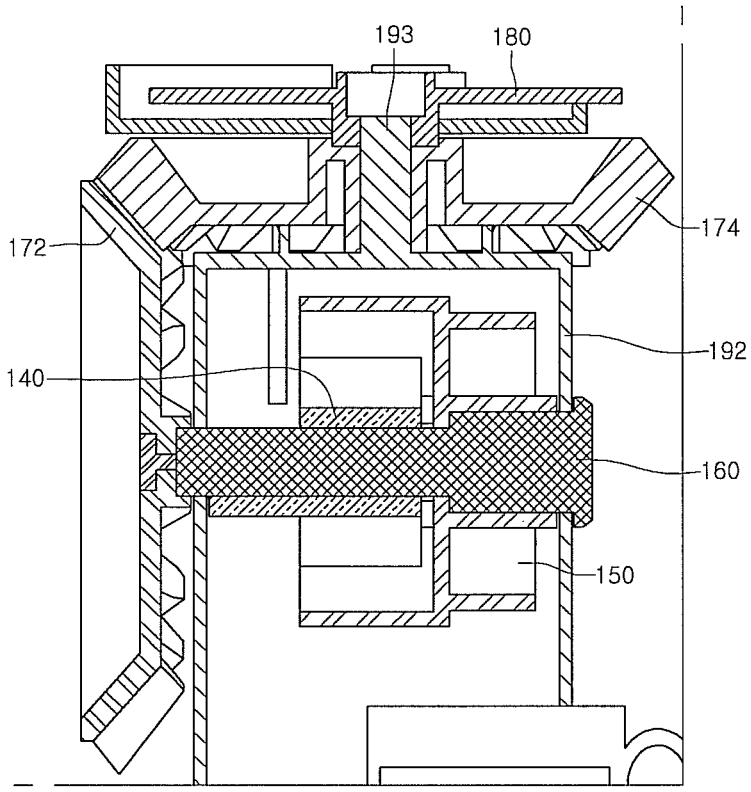
FIG. 5 is a cross-sectional view showing the construction of a height adjustment device according to the embodiment of the present invention.

FIG. 3 is a perspective view showing the inner configuration of the suction nozzle according to the embodiment of the present invention, FIG. 4 is a partially exploded perspective view of the suction nozzle according to the embodiment of the present invention, and FIG. 5 is a cross-sectional view showing the construction of the height adjustment device according to the embodiment of the present invention.

Referring to FIGS. 3 to 5, according to the embodiment of the present invention, the suction nozzle 20 is provided with the height adjustment device 100 which controls the height of the suction nozzle 20.

The height adjustment device 100 is provided with a manipulation portion 110 operated by the user, a height adjustment unit 210 provided in the lower side of the suction nozzle 20 to control the height of the suction nozzle 20, a plurality of transmission units 120 and 130 which transmits an operating force of the manipulation portion 110 to the height adjustment unit 210, and a display portion 180 to display the current height of the suction nozzle 20 while being moved together with the plurality of transmission units 120 and 130.

The plurality of transmission units 120 and 130 is provided with the first transmission unit 120 connected to the manipulation portion 110, and the second transmission unit 130 receiving the operating force from the first transmission and operating the height adjustment unit 210.

The first transmission unit 120 is provided with a first link 121 connected to the manipulation portion 110 and rotatably connected to the suction nozzle 20, a second link 123 rotatably connected to the first link 121 and transmitting the operating force from the manipulation portion 110 to the second transmission unit 130, and an elastic member 125 in which one end of thereof is connected to the second link 123 and other end of thereof is connected to the suction nozzle 20, thereby elasticity supporting the second link 123.

The elastic member 125 is extended if the manipulation portion 110 is operating, and is reduced for the manipulation portion 110 to be returned to the original position if the force operated by the manipulation portion 110 has removed.

The second transmission unit 130 is provided with a rotation guide member 140 connected to the second link 123, a rotation member 150 to be rotated by the rotation guide member 140, a fist gear 172 connected to shaft 160 passing though the rotating member 150 and rotating together with the rotating member 150, and a second gear 174 engaged with the first gear 172 and connected to the display unit 180.

Meanwhile, a gear supporting portion 192 which supports the each gear 172 and 174 is connected to the lower body 202. In addition, the shaft 160 is connected to the first gear 172 while passing through the gear supporting portion 192. In this time, the shaft 160 passing through the gear supporting portion 192 horizontally. Therefore, the first gear 172 is vertically rotated.

The upper side of the gear supporting portion 192 is provided with a rotating shaft 193 passing through the second gear 174 and the display portion 180. The rotating shaft 193 is protruded vertically upward from the upper surface of the supporting portion 192. Therefore, the second gear 174 is vertically rotated. That is, the rotation shaft of the first gear 172 and the rotation shaft of the second gear 174 are inclined, in more detail, orthogonal each other.

The embodiment of the present invention, the vertical rotation means rotating based on the rotation center horizontally extended with regard to bottom surface, and the horizontal rotation means rotating based on the rotation center vertically extended with regard to bottom surface.

The embodiment of the present invention, for the interest of the vertical rotation of the first gear 172 and the horizontal rotation of the second gear 174, each of the gears 172, 174 is formed of a type of bevel gears.

Meanwhile, the display supporter 194 supporting the display potion 180 is connected to the upper side of the gear supporting portion in a state where the second gear 174 is connected to the rotation shaft. The display portion supporter 194 is provided with a hole 195 in which the rotation shaft passing through.

The display portion 180 is formed of a disk-like, and a plurality of holes 182 is formed of type of symbol or character (as an example, H: High, MH: middle high, M: middle, ML: middle low, L: Low) to display the current height of the suction nozzle 20. The upper surface of the display portion 180 is substantially horizontal with regard to the bottom surface.

In the embodiment of the present invention, the symbols or characters are called a display unit.

In addition, the upper surface of the display supporter 194 is provided with a coating portion with specific colors so that the user may easily recognize any one hole of the plurality of holes (the hole is to display the current height of the suction nozzle). The coating portion 196 may be attached to the upper surface of the display supporter 194 by adhesive materials as an example.

In contrast, the coating portion 196 may be coated on the display portion supporter 194 by spaying materials with specific colors. In addition, the coating portion 196 may be a fluorescent color as an example, but the color of the coating portion 196 is not limited in embodiment of the present invention Therefore, the user may recognize the coating portion 196 through the hole 182 of the display portion 180, while recognizing the shape of the hole 182. In addition, the user may confirm the current height of the suction nozzle 20 by recognizing the shape of the hole 182.

Further, when the second gear 174 is vertically rotated, the display portion 180 is horizontally rotated, too When the display portion 180 is horizontally rotated, the user may recognize the hole 182 of the display portion 180 even long distance.

Meanwhile, the height adjustment unit 210 is provided with a shaft 211, a plurality of wheel coupling portions 212 each provided to be bent at both ends of the shaft 211 and coupled with an auxiliary wheel 214 for the movement of the suction nozzle 20, and the extension portion 231 vertically extended from any one of the plurality of the wheel coupling portion and comes be contacted with the rotation member 150.

In addition, the shaft 211 may be rotated by the rotation of the rotation member 150, and the height of the suction nozzle 20 may be adjusted.

In more details, the plurality of wheel coupling portion 212 is bended from the shat 211, such that the rotation central line L2 of the auxiliary wheel 214 and the rotation central line L1 of the shaft 211 may be spaced apart from each other. In addition, the rotation central line L2 of the auxiliary wheel 214 may be located at the same height as the bottom surface and the central line L1 of the shaft 211.

Further, according to the rotation of the shaft 211, the height of the rotation central line L2 of the auxiliary wheel 214 may be lower than the height of the rotation central line L1 of the shaft 211, such that the height of the suction nozzle 20 may be increased by a vertical distance between the rotation central L1 of the shaft 211 and the rotation central line L2 of the auxiliary wheel 214.

Meanwhile, the height adjustment unit 210 may prevent a separation from the lower body 202 by the cover 215 coupled to the lower body 202.

Hereinafter, the construction of the rotation guide member 140 and the rotation member 150 will be described.

Figure 6:
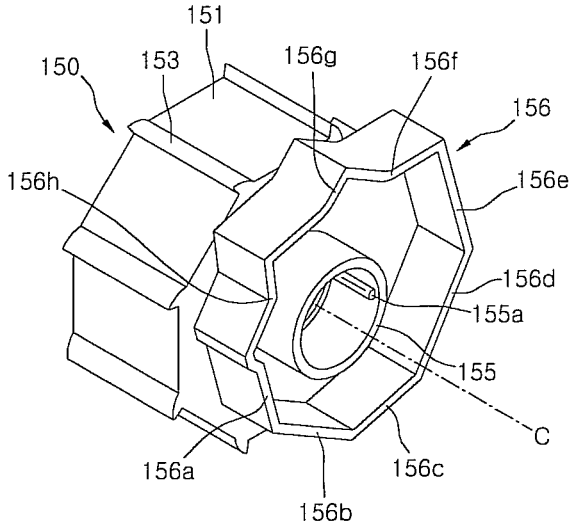
FIGS. 6 and 7 are a perspective view of a rotation member according to the embodiment of the present invention.
Figure 7:
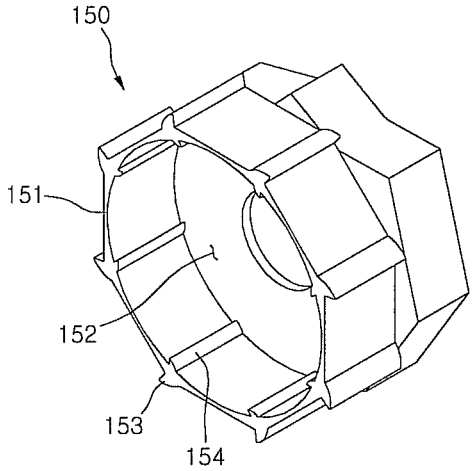
Figure 8:
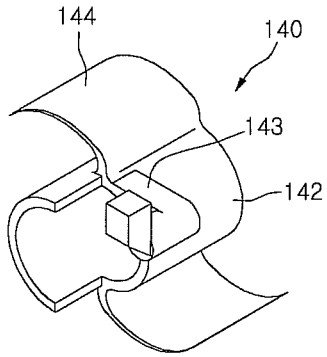
FIG. 8 is a perspective view of a rotation guide member according to the embodiment of the present invention.

FIGS. 6 and 7 are perspective views of a rotation member according to the embodiment of the present invention, and FIG. 8 is a perspective view of a rotation guide member according to the embodiment of the present invention.

Referring to FIGS. 4, 6 to 8, the rotation guide member 140 is accommodated in the rotation member 150, and guides the rotation member 150 to be rotated when the manipulation portion 110 is operated.

In the embodiment described above, in the rotation direction of the rotation member 150 and the rotation guide member 140, one direction means clockwise rotation based on FIG. 4, and other direction means counterclockwise rotation based on FIG. 4.

The rotation guide member 140 is provided with a body 142 coupled with the shaft 160. The outer peripheral surface of the body 142 is provided with a plurality of transmission portion 144 transmitting the rotation force of the body 142 to the rotation member 150. The plurality of transmission portions 144 are spaced apart from each other, and are extended at the body 142 outside. In addition, the coupling portion 143 coupling the second link 123 is protruded in the body 142. Therefore, when the manipulation portion 110 is operated, the second link 123 pulls the coupling portion 143, such that the rotation guide member 140 is rotated.

Meanwhile, the rotation member 150 is provided with a first body 151 accommodating the rotation guide member 14, a second body 156 coupled with the extension portion 213 of the height adjustment unit 210, and the support portion 155 formed with a rib 155*a* for preventing the shaft 160 from ticking over with regard to the rotation member 150 while increasing the contact area with the shaft 160.

The accommodation portion 152 accommodating the rotation guide member 140 is provided in the first body 151. A plurality of inner hitch portions 154 hitching the plurality of transmission portion 144 is provided with the inner peripheral surface of the first body 151. The plurality of inner hitching portions 154 are spaced apart from each other at the predetermined intervals.

In addition, when the rotation guide member 140 is rotated in one direction, the transmission portion 144 is hitched in the inner hitching portion 154, such that the rotation member 150 is rotated. Meanwhile, when the rotation guide member 140 is rotated in other direction, the transmission portion 144 is not hitched in the inner hitching portion 154, such that the rotation member 150 is maintained in the stationary state.

The outer peripheral surface of the first body 151 is provided with the outer hitching portion inserted into the stopper 164 fixing the position at the state where the rotation member 150 is rotated at the state rotated at a predetermined angle in one direction. The stopper 164 may be coupled with the lower body 202.

In more details, the second link 123 coupled with the rotation guide member 140 is coupled with the elastic member 125, such that when the operating force applied to the manipulation portion 110 is removed, the second link 123 returns to the original position by the resilient force of the elastic member 125. In this time, when the second link 123 returns to the original position, the rotation guide member 140 is rotated in other direction.

In this case, since the transmission portion 144 of the rotation guide member 140 is contacted with the inner peripheral surface of the first body 151, when the rotation guide member 140 is rotated in the other direction, the rotation member 150 will also try to rotate the other direction.

However, when the rotation member 150 is rotated in clockwise, there is a problem that the state of the adjusted height again returns to previous state.

Therefore, in the embodiment, even although the rotation guide member 140 again returns to original position, the rotating position of the rotation member 150 is fixed by the stopper 164. Therefore, the height adjustment state of the suction nozzle 20 may be maintained.

The second body 156 is provided with a plurality of pressure portions 156*a* to 156*h* selectively contacted with the extension portion 213.

In addition, the distance between the rotation central axis C of the rotation member 150 and any one pressure portion (as an example, the first pressure portion 156*a*) is different from the distance between the rotation central axis C of the rotation member 150 and other pressure portion (as an example, the second pressure portion 156*b*) adjacent to the one pressure portion 156*a*.

In more details, in the embodiment, the plurality of pressure portions includes the first to eighth pressure portions.

In addition, a distance from the second pressure portion 156*b* to the rotation central axis C is provided so as to be the longer distance than a distance from the first pressure portion 156*a* to the rotation central axis C. In addition, a distance from the third pressure portion 156*c* to the rotation central axis C is provided so as to be the longer distance than the distance from the second pressure portion 156*b* to the rotation central axis C. In addition, a distance from the fourth pressure portion 156*d* to the rotation central axis C is provided so as to be the longer distance than the distance from the third pressure portion 156*c* to the rotation central axis C. In addition, a distance from the fifth pressure portion 156*e* to the rotation central axis C is provided so as to be the longer distance than the distance from the fourth pressure portion 156*b* to the rotation central axis C.

Meanwhile, a distance from the sixth pressure portion 156*f* to the rotation central axis C is provided so as to be the shorter distance than a distance from the fifth pressure portion 156*e* to the rotation central axis C. In addition, a distance from the seventh pressure portion 156*g* to the rotation central axis C is provided so as to be the shorter distance than the distance from the sixth pressure portion 156*f* to the rotation central axis C. In addition, a distance from the eighth pressure portion 156*h* to the rotation central axis C is provided so as to be the shorter distance than the distance from the seventh pressure portion 156*g* to the rotation central axis C. In addition, a distance from the eighth pressure portion 156*h* to the rotation central axis C is provided so as to be the longer distance than the distance from the first pressure portion 156*a* to the rotation central axis C.

In addition, the distance from the second pressure portion 156*b* to the rotation central axis C is provided so as to be the same distance than the distance from the eighth pressure portion 156*h* to the rotation central axis C. In addition, the distance from the third pressure portion 156*c* to the rotation central axis C is provided so as to be the same distance than the distance from the seventh pressure portion 156*g* to the rotation central axis C. In addition, the distance from the fourth pressure portion 156*d* to the rotation central axis C is provided so as to be the same distance than the distance from the sixth pressure portion 156*f* to the rotation central axis C.

In this time, when the distance from the pressure portion to the rotation central axis is more increased, the rotation angle of the extension portion 213 is increased. As a result, the vertical distance between the rotation central line L1 of the shaft 211 and the rotation central line L2 is increased, such that the height of the suction nozzle 20 may be increased.

Therefore, the height of the suction nozzle 20 is minimized in a state where the first pressure portion 156*a* presses the extension portion 213, and the height of the suction nozzle 20 is maximized in a state where the rotation member 150 is rotated, the fifth pressure portion 156*e* presses the extension portion 213.

In addition, during the process of making one revolution of the rotation member 150, the height of the suction nozzle 20 is stepwise increased and then is stepwise decreased.

In the embodiment, the plurality of pressure portion 156*a* to 156*h* includes the eight pressure portions, but the number of the pressure portion is not limited. Thus, the height of the suction nozzle may be adjusted by adjusting the number of the pressure portion.

Figure 9:
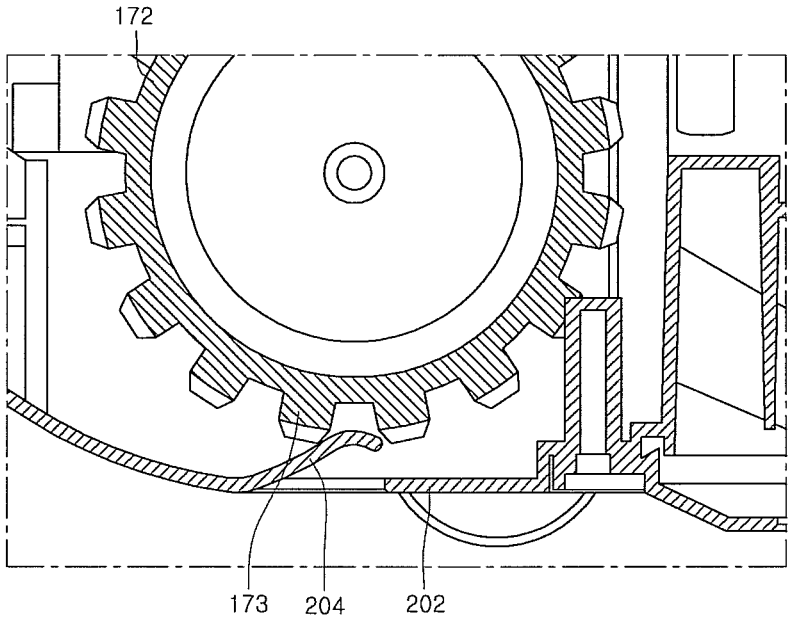
FIG. 9 is a partial cross-sectional view a suction nozzle to show the structure of a gear stopper according to the embodiment of the present invention.

FIG. 9 is a partial cross-sectional view a suction nozzle to show the structure of a gear stopper according to the embodiment.

Referring to FIGS. 4 and 9, the lower body 202 is provided with the gear stopper 204 to maintain the position rotated of the first gear 172. The gear stopper 204 is provided at the lower body 202 to be elasticity operated. The gear stopper 204 may be provided to be bent upward in state where the part of the lower body 202 is cut, as an example. In addition, the gear stopper 204 is disposed between adjacent two gear teeth 173

Therefore, during the rotation of the rotation member 150, the gear stopper 204 is elastically deformed, and the first gear 172 may be rotated. Meanwhile, when the rotation member 150 is in a stationary state, the gear stopper 204 is disposed between adjacent two gear teeth 173 to prevent the rotation of the first gear 172.

Therefore, in a state where the force of the manipulation portion 110 is removed, the rotation of the first gear 172 is prevented, such that the hole 182 of the display portion 180 and the coating portion 196 may be maintained in an aligned state upward and downward.

That is, since the second gear 174 and the display portion 180 are rotated together with by the first gear 172, when the rotation of the first gear 172 is prevented, the rotation of the display portion 180 is prevented. Therefore, the hole of the display portion and coating portion 196 may be maintained in the aligned state upward and downward.

Hereinafter, the operation of the height adjustment device will be described.

Figure 10:
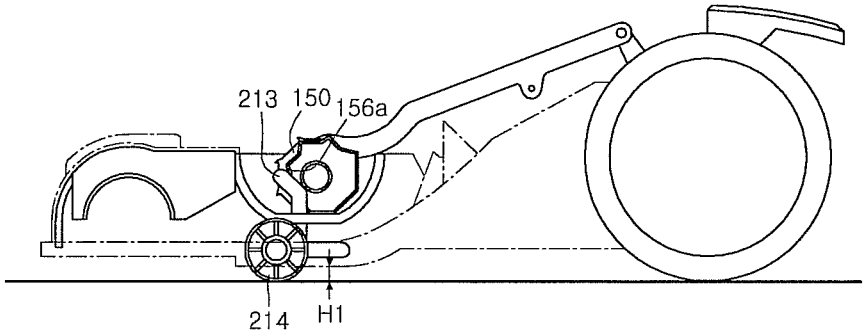
FIG. 10 is view showing a state where the height of the suction nozzle is the lowest.
Figure 11:
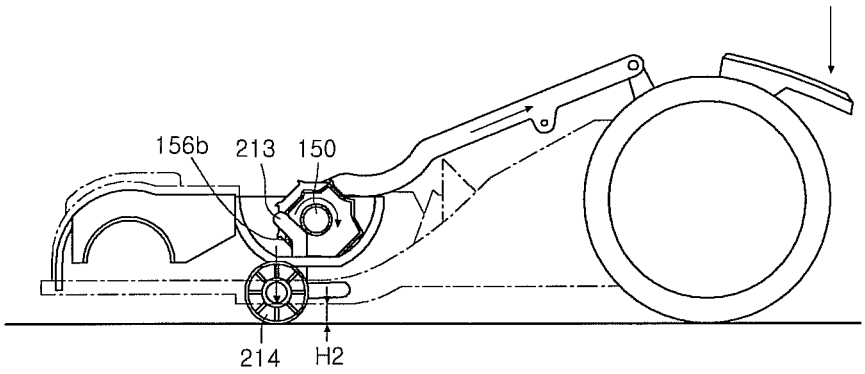
FIG. 11 is view showing a state where the height of the suction nozzle is higher than that of FIG. 10.

FIG. 10 is a view showing a state where the height of the suction nozzle is the lowest, and FIG. 11 is view showing a state where the height of the suction nozzle is higher than that of FIG. 10.

Referring to FIGS. 3 to 11, when cleaning the bottom surface such as a carpet, the height of the suction nozzle 20 is adjusted, thereby making the agitator provided in the suction nozzle 20 to rotate smoothly.

Herein, when the height of the suction nozzle 20 is the lowest state H1, as mentioned above, the first pressure portion 156*a* is contacted with the extension portion 213 of the height adjustment unit 210.

In order to adjust the height of the suction nozzle 20, as an example, if the user operates the manipulation portion 110 to increase the height of the suction nozzle 20, the operating force of the manipulation portion 110 is transmitted to the rotation guide member 140 by the first transmission unit 120.

Then, the rotation guide member 140 is rotated in one direction. If the rotation guide member 140 is rotated in one direction, the rotation member 150 and the first gear 172 are rotated in one direction. Then, a special pressure portion (as an example, the second pressure portion 156) of the rotation member 150 presses the extension portion 213. Accordingly, the extension portion 213 is rotated, and the height of the suction nozzle 20 is increased (H2).

In addition, if the first gear 172 is rotated in one direction, the second gear 174 engaged with the first gear 172 is rotated, and the display portion 180 is rotated by the second gear 174. Therefore, the user may confirm the current height of the suction nozzle 20 through the display portion 180.

Meanwhile, when the operating force applied to the manipulation portion 110 is removed, the position of the second link 123 returns to the original position by the resilient force of the elastic member 125. Accordingly, the rotation guide member 140 is rotated in other direction and returns to the original position.

In this time, since the rotation of the rotation member 150 is prevented by the stopper 164, the adjusted height of the suction nozzle is maintained.

According to the embodiment, since the height of the suction nozzle may be selectively adjusted, the movement of the suction nozzle may be easy while making the agitator to rotate smoothly, regardless of the state of a surface to be cleaned.

In addition, since the display portion which displays the current position of the suction nozzle is horizontally rotated and the display window is formed in the upper body, the display portion may be visible to the naked eye easily.

In addition, since the display portion is moved by the transmission unit to transmit an operating force of the manipulation portion to the height adjustment unit, an extra manipulation portion or a driving motor and the like to make the display portion tick are unnecessary.

Figure 12:
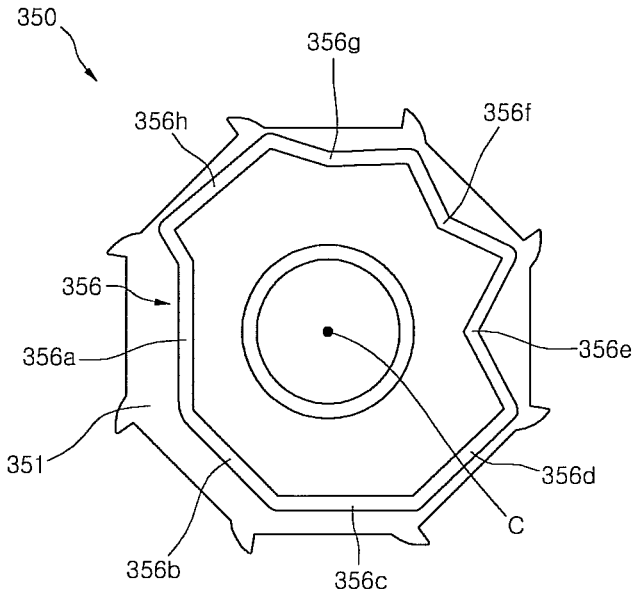
FIG. 12 is a lateral view of the rotation member of the embodiment of the present invention.

FIG. 12 is a lateral view of the rotation member of the embodiment of the present invention.

The embodiment is the same as the previous embodiment as described above, but the shape of the second body of the rotation member is different from that of the previous embodiment. Therefore, a characterized part of the embodiment will be only described hereinafter.

Referring to FIG. 12, the rotation member 350 of the embodiment includes the first body 351 and the second body 356. The second body 356 includes a plurality of pressure portions 356*a* to 356*h* which presses the extension portion (refer to 213 of FIG. 4).

In more details, in the embodiment, the plurality of pressure portions includes the first to eighth pressure portions.

In addition, a distance from a second pressure portion (356*b*) to the rotation central axis C of the rotation member 350 is provided so as to be the longer distance than a distance from the first pressure portion 356*a* to the rotation central axis C. In addition, a distance from a third pressure portion (356*c*) to the rotation central axis C is provided so as to have the longer distance than the distance from the second pressure portion 356*b* to the rotation central axis C. In addition, a distance from a fourth pressure portion 356*d* to the rotation central axis C is provided so as to be the longer distance than the distance from the third pressure portion 356*c* to the rotation central axis C.

In addition, the distance from the first pressure portion (356*a*) to the rotation central axis C is the same distance than a distance from a fifth pressure portion 356*e* to the rotation central axis C. In addition, the distance from the second pressure portion 356*b* to the rotation central axis C is the same distance than a distance from a sixth pressure portion 356*f* to the rotation central axis C. In addition, the distance from the third pressure portion 356*c* to the rotation central axis C is the same distance than a distance from a seventh pressure portion 356*g* to the rotation central axis C. In addition, the distance from the fourth pressure portion (356*b*) to the rotation central axis C is the same distance than a distance from an eighth pressure portion 356*h* to the rotation central axis C.

Therefore, the height of the suction nozzle 20 is minimized in a state where the first pressure portion 356*a* or the fifth pressure portion 356*e* presses the extension portion 213, and the height of the suction nozzle 20 is maximized in a state where the rotation member 350 is rotated, and the fourth pressure portion 356*d* or the eighth pressure portion 356*h* presses the extension portion 213.

In addition, during the process of rotating of the rotation member 150, the height of the suction nozzle 20 is stepwise increased and then is maximized. In addition, if the rotation member 350 is more rotated in a predetermined angle at a state where the height of the suction nozzle 20 is maximized, the height of the suction nozzle 20 is minimized.

Even although the embodiments in which the height adjustment device is applied to a suction nozzle of an upright type vacuum cleaner are described above, it is notes that the height adjustment device may be applied to a canister type vacuum cleaner.

What is claimed is:

1. A vacuum cleaner, comprising:

a suction nozzle provided with a suction inlet;

a cleaner body that communicates with the suction inlet of the suction nozzle;

the suction nozzle includes a manipulation portion;

a height adjustment device to adjust a height of the suction nozzle with regard to a bottom surface;

a transmission device to transmit an operating force from the manipulation portion to the height adjustment device; and a display moved by the transmission device to display the current height of the suction nozzle, wherein the transmission device includes: a first transmission device connected to the manipulation portion; and a second transmission device connected to the first transmission device and the display, wherein the second transmission device comprises a rotation guide which receives the operating force from the first transmission device, and a rotation member rotated by the rotation guide, wherein the display is rotated about an axis perpendicular to an rotational axis of the rotation member.

2. The vacuum cleaner according to claim 1, wherein the display is rotated about the axis perpendicular to the bottom surface.

3. The vacuum cleaner according to claim 2, wherein the suction nozzle is provided with a display window to confirm the display.

4. The vacuum cleaner according to claim 2, wherein the display is provided with a plurality of holes in which the shape of a symbol or character which displays the current height of the suction nozzle is provided.

5. The vacuum cleaner according to claim 4, further comprising a supporter supporting the display, the supporter is provided with a coating having specific colors to recognize the holes.

6. The vacuum cleaner according to claim 1, wherein the second transmission device further includes:

a first gear connected to the rotation member; and a second gear engaged with the first gear and rotated together with the display.

7. The vacuum cleaner according to claim 6, wherein a rotation central axis of the first gear is titled with a rotation central axis of the second gear at a predetermined angle.

8. The vacuum cleaner according to claim 6, wherein the height adjustment device includes:

a shaft;

a plurality of wheel couplings provided to be bent at both ends of the shaft and coupled with an auxiliary wheel to enable movement of the suction nozzle; and an extension vertically extended at any one of the plurality of wheel couplings and contacting the rotation member.

9. A vacuum cleaner, comprising:

a cleaner body;

a suction nozzle that communicates with the cleaner body to adjust a height with regard to a bottom surface;

a display to display the current height of the suction nozzle; and a display supporter that supports the display portion, wherein the display is rotated during height adjustment of the suction nozzle, and an upper surface of the display is provided with a plurality of display units which display the height of the suction nozzle, wherein the display is rotated about an axis perpendicular to the bottom surface.

10. The vacuum cleaner according to claim 9, wherein the plurality of display units are holes provided with a symbol or character.

11. The vacuum cleaner according to claim 10, wherein the display supporter is provided with a coating having specific colors to recognize the holes.

12. The vacuum cleaner according to claim 9, wherein the vacuum cleaner includes:

a manipulation portion generating an operating force for the height adjustment of the suction nozzle;

a height adjustment device provided in the lower side of the suction nozzle to adjust the height of the suction nozzle with regard to the bottom surface; and a transmission device which transmits the operating force of the manipulation portion to the height adjustment device and the display portion.

13. The vacuum cleaner according to claim 12, wherein the transmission device includes:

a first gear which receives the operating force generated from the manipulation portion; and a second gear engaged with the first gear, the display is connected to the second gear.

14. A vacuum cleaner, comprising:

a cleaner body;

a suction nozzle that communicates with the cleaner body to adjust a height with regard to a bottom surface;

a display to display the current height of the suction nozzle and having a plurality of holes to display the height of the suction nozzle; and a display supporter that supports the display portion, wherein the display is rotated during the height adjustment of the suction nozzle, wherein the supporter is provided with a coating having specific colors to recognize the plurality of holes.

15. The vacuum cleaner according to claim 14, further comprising:

a manipulation portion that generates an operating force for the height adjustment of the suction nozzle;

a height adjustment device provided in the lower side of the suction nozzle to adjust the height of the suction nozzle with regard to the bottom surface; and a transmission device that transmits the operating force of the manipulation portion to the height adjustment device and the display.

16. The vacuum cleaner according to claim 15, wherein transmission device comprises:

a first transmission device connected to the manipulation portion; and a second transmission device connected to the first transmission device.

17. The vacuum cleaner according to claim 16, wherein the second transmission device comprises:

a rotation guide which receives the operating force from the first transmission device;

a rotation member rotated by the rotation guide;

a first gear connected to the rotation member; and a second gear engaged with the first gear and rotated together with the display.

18. The vacuum cleaner according to claim 17, wherein a rotation central axis of the first gear is titled with a rotation central axis of the second gear at a predetermined angle.

* * * * *